United States Patent [19]

Kaneko et al.

[11] Patent Number: 5,072,508

[45] Date of Patent: Dec. 17, 1991

[54] METHOD OF MAKING AN INDUCTIVE-RESISTIVE CIRCUIT ELEMENT

[75] Inventors: Toshimi Kaneko; Eiichi Maeda, both of Nagaokakyo, Japan

[73] Assignee: Murata Mfg. Co., Ltd., Japan

[21] Appl. No.: 662,519

[22] Filed: Feb. 28, 1991

Related U.S. Application Data

[62] Division of Ser. No. 369,730, Jun. 22, 1989, abandoned.

[30] Foreign Application Priority Data

Jun. 23, 1988 [JP] Japan ..... 63-83370

[51] Int. Cl.[5] ..... H01F 41/10

[52] U.S. Cl. ..... 29/605; 29/621; 333/185

[58] Field of Search ..... 29/605, 602.1, 610, 29/621; 336/192, 198, 208, 96, 183, 221; 333/172, 185

[56] References Cited

U.S. PATENT DOCUMENTS

| | | | |
|---|---|---|---|
| 3,812,442 | 5/1974 | Muckelroy | 336/200 X |
| 3,833,872 | 9/1974 | Marcus et al. | 336/183 X |
| 4,400,674 | 8/1986 | Suda et al. | 336/192 X |
| 4,455,544 | 6/1984 | Sibille et al. | 336/192 X |
| 4,490,706 | 12/1984 | Satou et al. | 336/96 |
| 4,498,067 | 2/1985 | Kumokawa et al. | 336/192 |
| 4,595,901 | 6/1908 | Yahagi | 336/192 |
| 4,717,901 | 1/1988 | Autenrieth et al. | 336/192 X |
| 4,769,900 | 9/1988 | Morinaga et al. | 336/192 X |

*Primary Examiner*—Carl E. Hall

*Attorney, Agent, or Firm*—Ostrolenk, Faber, Gerb & Soffen

[57] ABSTRACT

An inductor for noise reduction characterized in that wire is wound around a core member formed of a magnetic substance and the magnetic substance is composed of a material having insulation resistance of 0.5 to 5 kilo-ohms.

9 Claims, 2 Drawing Sheets

METHOD OF MAKING AN INDUCTIVE-RESISTIVE CIRCUIT ELEMENT

This is a divisional of application Ser. No. 07/369,730 filed on June 22, 1989, now abandoned.

BACKGROUND OF THE INVENTION

1. Field of the Invention

The present invention relates to an improvement in an inductor for noise reduction constructed by winding wire around a core member.

2. Description of the Prior Art

Conventionally, an inductor comprising a core member formed of a magnetic substance such as ferrite, and having flange portions at both ends and wire wound around a portion between the flange portions of this core member, has been widely used as an inductor for noise reduction.

In the inductor constructed as described above, a resonant point caused by stray capacitance or the like formed between turns of the wound wire exists at high frequencies. Thus, frequencies higher than the resonant point, the inductor acts like a capacitor rather than an inductor.

Accordingly, when the above described inductor is used as an inductor for noise reduction, the impedance rapidly changes in the vicinity of the resonant point, resulting in a phenomenon such as oscillation. Thus, there is a problem of being unable to effectively remove noise.

On the other hand, a construction has been known in which a resistor is connected in parallel with the inductor so as to restrain the above described phenomenon such as oscillation. When the resistor is connected, as a separate part, in parallel with the inductor, however, there are some problems. For example, manufacturing cost is increased and it is difficult to meet the requirement for miniaturization.

SUMMARY OF THE INVENTION

Accordingly, an object of the present invention is to provide a noise reduction inductor capable of effectively reducing noise even in a high frequency region and meeting the requirement for miniaturization.

The present invention provides a noise reduction inductor which comprises a core member formed of a magnetic substance and wire wound around the core member, the magnetic substance being composed of a material having insulation resistance of 0.5 to 5 kilo-ohms. More specifically, in the present invention, the core member is formed of the material having the above described insulation resistance, so that the core member itself is also used as a resistor, thereby to restrain oscillation in a high frequency region without increasing the number of parts.

In order to set the insulation resistance of the core member to 0.5 to 5 kilo-ohms, it is necessary to decrease the resistance value of a member formed of a magnetic substance having relatively high insulation, by coating the surface of the member with a reducing agent and sintering the magnetic substance, or by sintering the magnetic substance in a reducing atmosphere.

In the present invention, the core member is formed of a magnetic substance having relatively low insulation resistance of 0.5 to 5 kilo-ohms to achieve a construction which is equivalent to a resistor is connected in parallel to the wire. Accordingly, the variation in impedance in a frequency region in the vicinity of a resonant point can be reduced, and oscillations phenomenon are restrained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
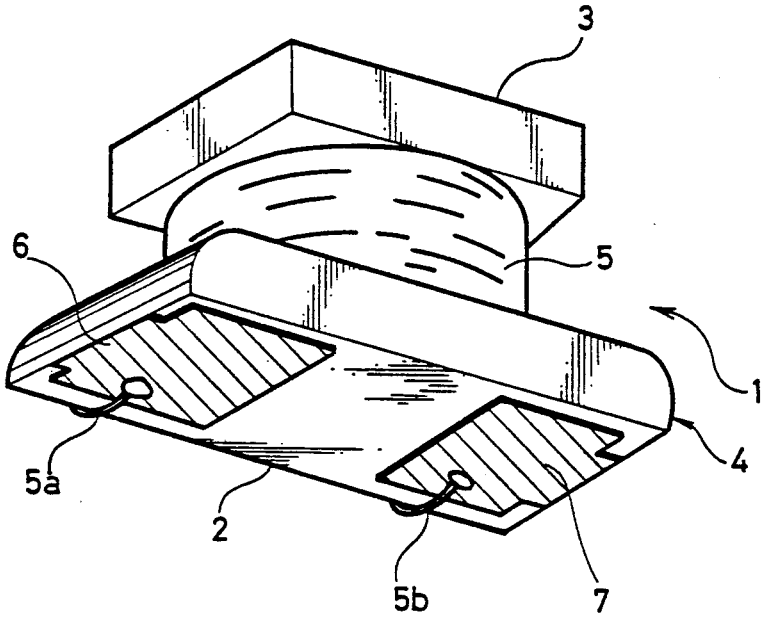
FIG. 1 is a perspective view showing schematically an inductor for noise reduction according to an embodiment of the present invention.

FIG. 1 is a perspective view showing schematically a noise inductor according to an embodiment of the present invention. A noise reduction inductor 1 uses a core member 4 having flange portions 2 and 3 at opposite ends. This core member 4 is formed of a magnetic substance such as ferrite that is adjusted to have a, relatively small insulation resistance as described below.

Wire 5 is wound around the core member 4 between the flange portions 2 and 3 of the core member 4.

A pair of electrodes 6 and 7 are formed spaced apart from each other by a predetermined distance on an outer surface of the flange portion 2. Opposite ends 5*a* and 5*b* of the wound wire 5 are electrically connected to the electrodes 6 and 7, respectively, by soldering.

The inductor 1 according to the present embodiment is characterized in that the insulation resistance of the core member 4 formed of a magnetic substance is set to 0.5 to 5 kilo-ohms. The normal magnetic substance such as ferrite which has been conventionally used in the inductor has relatively high insulation resistance of approximately 10 Mega-ohms, and thus it is difficult to cause the core member formed of the magnetic substance to function as a resistor.

Figure 2:
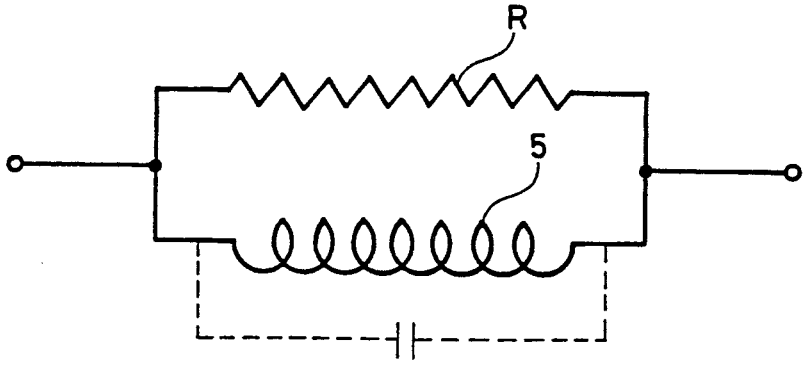
FIG. 2 is a diagram showing an equivalent circuit of the inductor according to an embodiment of the present invention.

According to the present embodiment, the resistance value of the core member 4 itself is adjusted to a value of 0.5 to 5 kilo-ohms by forming a magnetic substance in the shape of the core member 4 as shown, and then either coating the surface thereof with a reducing agent an sintering the coated magnetic substance, or sintering the magnetic substance in a reducing atmosphere. Thus, the inductor 1 has an equivalent circuit in which a resistor R is connected in parallel with the wire 5, as shown in FIG. 2.

Figure 3:
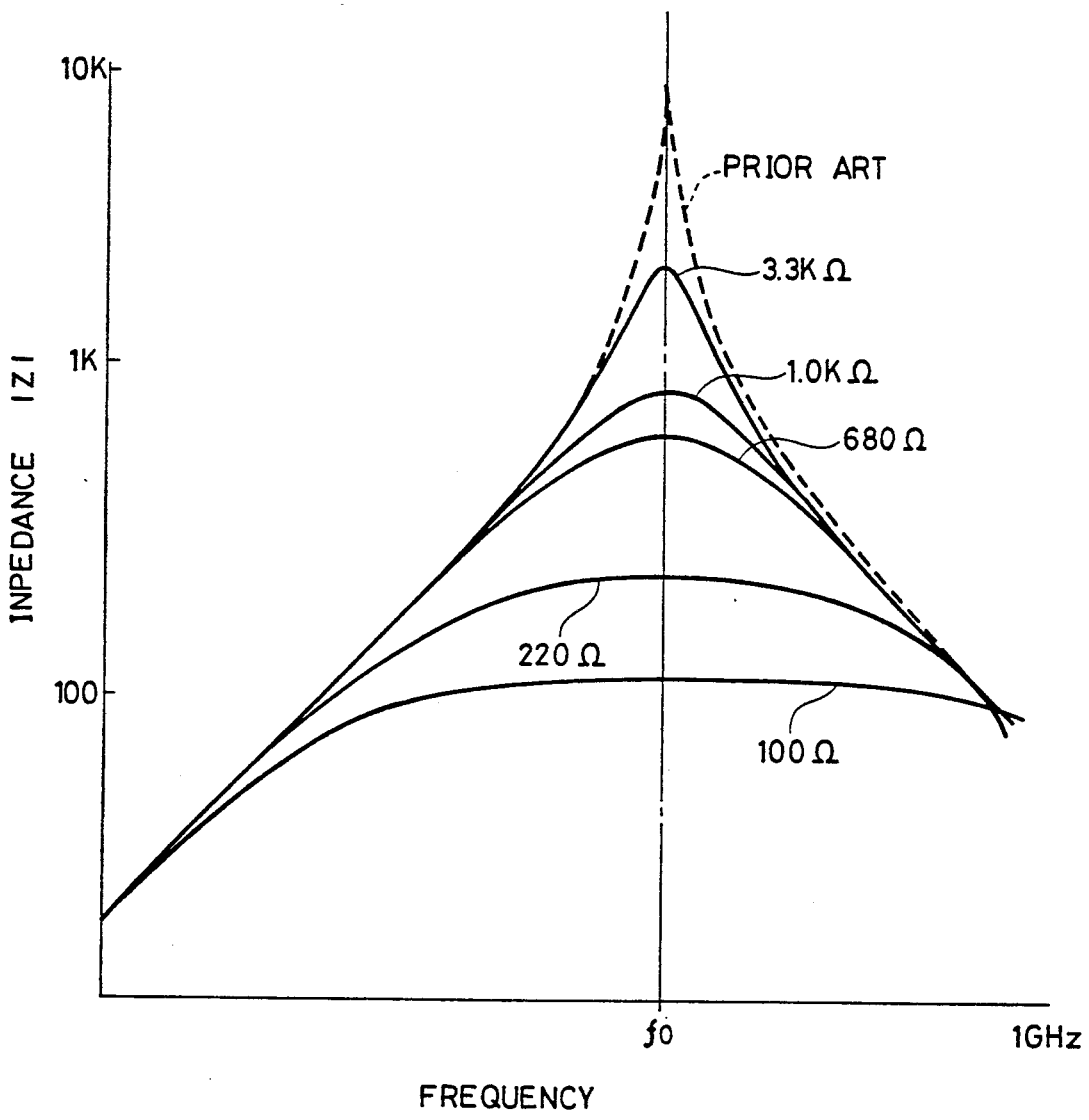
FIG. 3 is a diagram showing the variation in impedance at a resonant point when the insulation resistance of a core member is changed to various values.

FIG. 3 shows impedance-frequency characteristics in the vicinity of a resonant point associated with the inductor 1 shown in FIG. 1 in which the core member 4 is formed of a ferrite and the insulation resistance of the ferrite is set to 100 ohms, 220 ohms, 680 ohms, 1 kilo-ohms and 3.3 kilo-ohms respectively, and the case of a conventional inductor (the dashed line) for noise reduction in which the core member is formed of the normal ferrite.

As can be seen from FIG. 3, in the inductor of the prior art using the core member formed of the normal ferrite, an impedance curve has a sharp peak in the vicinity of the resonant point and the impedance changes rapidly there. On the other hand, when the core member 4 is formed of the above described material having a variety of different insulation resistance values, a rapid change of the impedance in the vicinity of the resonant point is restrained as the resistance value is decreased. Thus, it is found that the oscillation phenomenon in the vicinity of the resonant point can be restrained by reducing the insulation resistance of the core member 4 formed of a magnetic substance. According to the present invention, the insulation resistance of the core member 4 is selected to be 5 kilo-ohms or less.

On the other hand, when the insulation resistance of the core member 4 is less than 0.5 kilo-ohms, the effect of connecting the resistor to the wire is not satisfactory, so that considerable noise reduction can not be obtained. Accordingly, in the present invention, the insulation resistance of the core member 4 is within a range of 0.5 to 5 kilo-ohms. More specifically, with an inductor 1 according to the present embodiment, noise is reduced according to the impedance of the wound wire 5 at frequencies lower than a resonant point f and in the same applies to a conventional inductor having the same physical structure as the disclosed embodiment. But with the invention, noise is reduced according to the impedance of the resistor equivalently connected to the wire 5, high frequencies region in the vicinity of the resonant point $f_0$.

Although the inductor 1 shown in FIG. 1 has a structure in which the pair of electrodes 6 and 7 are formed on an outer surface of the flange portion 2 (to enable it, to be face-bonded), the inductor according to the present invention is not limited to such a structure. For example, the electrodes 6 and 7 may be formed on side surfaces of the flange portion 2 or may be formed on flange portions 2 and 3 respectively. In addition, lead terminals may be joined to major outer surfaces of the flange portions 2 and 3 to electrically connect both ends 5*a* and 5*b* of the wound wire 5 to the lead terminals.

Additionally, a core member having no flange portions may be used.

Although description was made of a case in which the resistance of the core member according to the present invention is 0.5 to 5 kilo-ohms, it should be noted that it is substantially necessary that the resistance between the electrodes electrically connected to both ends of the wound wire is 0.5 to 5 kilo-ohms.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of making an inductive-resistive circuit element for noise-reduction, comprising the steps of:

reducing the resistance of a core member made of a magnetic material by coating its surface with a reducing agent and sintering said coated core member, so that a sintered core member having a resistance of substantially 0.5 to 5.0 kilohms is obtained;

winding a wire having two opposite ends around said sintered core member; and electrically connecting a pair of electrodes to respective ends of said wire and to said core member, whereby said core member provides an electrical resistance between said electrodes of substantially 0.5 to 5 kilohms, in parallel with an inductance provided between said electrodes by said wire.

2. A method of making an inductive-resistive circuit element for noise-reduction, comprising the steps of:

sintering a core member having a resistance greater than 5.0 kilohms in a reducing atmosphere so that a sintered core member having a resistance of substantially 0.5 to 5.0 kilohms is obtained; and winding a wire having two opposite ends around said sintered core member; and electrically connecting a pair of electrodes to respective ends of said wire and to said core member, whereby said core member provides an electrical resistance between said electrodes of substantially 0.5 to 5 kilohms, in parallel with an inductance provided between said electrodes by said wire.

3. A method of making an inductive-resistive circuit element for noise reduction, comprising the steps of:

providing a core member formed of a magnetic substance having a resistance of substantially 0.5 to 5 kilohms;

winding a wire around said core member to form an inductance, said wire having two opposite ends; and electrically connecting a pair of electrodes to respective ends of said wire and to said core, so that said core member provides an electrical resistance between said electrodes of substantially 0.5 to 5 kilohms, in parallel with said inductance.

4. The method according to claim 3, wherein said core member is formed by coating the surface of a member formed of a magnetic substance with a reducing agent and sintering the magnetic substance.

5. The method according to claim 4, wherein said magnetic substance comprises a ferrite.

6. The method according to claim 3, wherein said core member is formed by sintering a magnetic substance having resistance of more than 5 kilohms in a reducing atmosphere to reduce the resistance of the core member to substantially between 0.5 and 5 kilohms.

7. The method according to claim 6, wherein said magnetic substance comprises a ferrite.

8. The method according to claim 3, wherein said core member has a core body portion and a pair of flange portions formed at opposite ends of said core body portion, said flange portions having a larger diameter than said core body portion.

9. The method according to claim 8, wherein said pair of electrodes are formed on an outer surface of one of said flange portions.

* * * * *